United States Patent [19]

Crowle

[11] 4,074,181

[45] Feb. 14, 1978

[54] VOLTAGE REGULATORS OF A TYPE USING A COMMON-BASE TRANSISTOR AMPLIFIER IN THE COLLECTOR-TO-BASE FEEDBACK OF THE REGULATOR TRANSISTOR

[75] Inventor: Brian Crowle, Ashford, England

[73] Assignee: RCA Corporation, New York, N.Y.

[21] Appl. No.: 746,887

[22] Filed: Dec. 2, 1976

[30] Foreign Application Priority Data

Dec. 4, 1975 United Kingdom ..... 49864/75

[51] Int. Cl.[2] ..... G05F 1/64

[52] U.S. Cl. ..... 323/8; 323/22 T; 323/69; 330/307; 323/19; 330/291

[58] Field of Search ..... 323/1, 4, 8, 22 T, 19, 323/69; 330/30 D

[56] References Cited

U.S. PATENT DOCUMENTS

| | | | |
|---|---|---|---|
| 3,617,859 | 11/1971 | Dobkin et al. | 323/69 |
| 3,820,007 | 6/1974 | Schilling et al. | 323/8 |
| 3,828,240 | 8/1974 | Keller et al. | 323/1 |
| 3,916,508 | 11/1975 | Conzelmann et al. | 323/8 |
| 4,017,788 | 4/1977 | Stepp et al. | 323/8 |

*Primary Examiner*—Gerald Goldberg
*Attorney, Agent, or Firm*—H. Christoffersen; A. L. Limberg

[57] ABSTRACT

Circuitry for providing temperature-compensated regulation of the voltage between first and second terminals includes a first, shunt regulator transistor with emitter and collector connected to the first and second terminals, respectively, and a direct coupled degenerative feedback connection between the second terminal and the base of the first transistor. This feedback connection includes a second transistor of the same conductivity type as the first transistor connected in common base-amplifier configuration, with a positive-temperature-coefficient offset potential being maintained between the second terminal and the emitter of the second transistor, with a negative-temperature-coefficient being applied between the first terminal and the base of the second transistor, and with a predetermined flow of current being maintained between the second terminal and the collector of the second transistor, which collector is direct-coupled to the base of said first transistor.

21 Claims, 4 Drawing Figures

Figure 1:
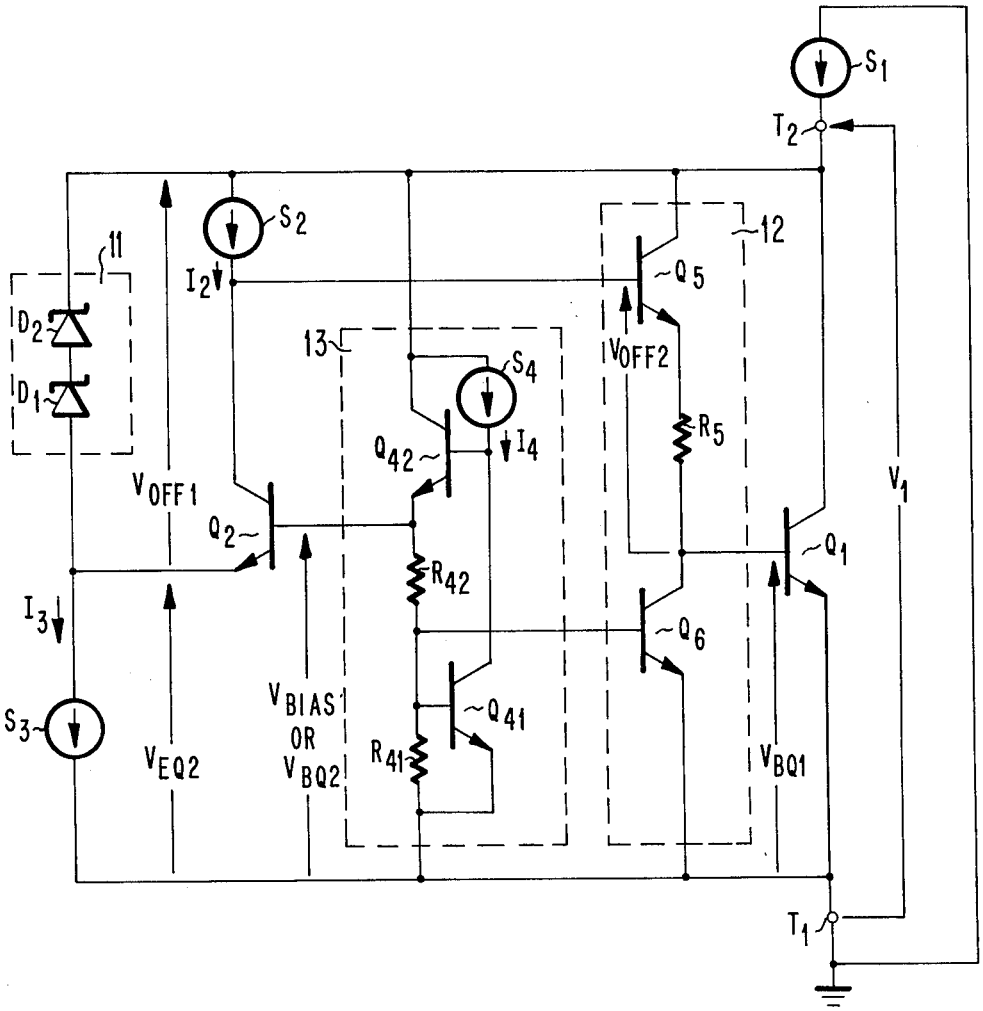

VOLTAGE REGULATORS OF A TYPE USING A COMMON-BASE TRANSISTOR AMPLIFIER IN THE COLLECTOR-TO-BASE FEEDBACK OF THE REGULATOR TRANSISTOR

This application relates to voltage regulators, particularly to ones suitable for being constructed in integrated circuit form and for providing temperature-compensated voltages.

Such voltage regulators are contemplated for use instead of avalanche or Zener diodes in order to overcome one or more of the following disadvantages of those conventional voltage regulating elements:

(a) the variation of regulated voltages by tens of millivolts per Kelvin temperature change (b) the rather high source impedance with slope resistance of the order of 10 ohms—i.e., 10 millivolts change in regulated voltage per milliampere change in current through the reference elements—and (c) the ready availability only of certain values of regulated voltage.

Temperature-compensated voltage regulators of the type in which the regulated voltage is dependent upon the difference in offset potentials across forward-biased semiconductor junctions operated at different current densities have previously been developed to replace avalanche or Zener diodes, with the aim of avoiding these disadvantages. However, this approach tends towards maintaining scaling factors between certain elements that are larger than desired, resulting in designs that take up excessive die area when integrated in monolithic form.

The present invention is embodied in a voltage regulator including first and second transistors of the same conductivity type. The first transistor is connected as a shunt regulator and is provided with a direct-coupled degenerative collector-to-base feedback connection which includes the second transistor in common-base amplifier configuration.

Figure 2:
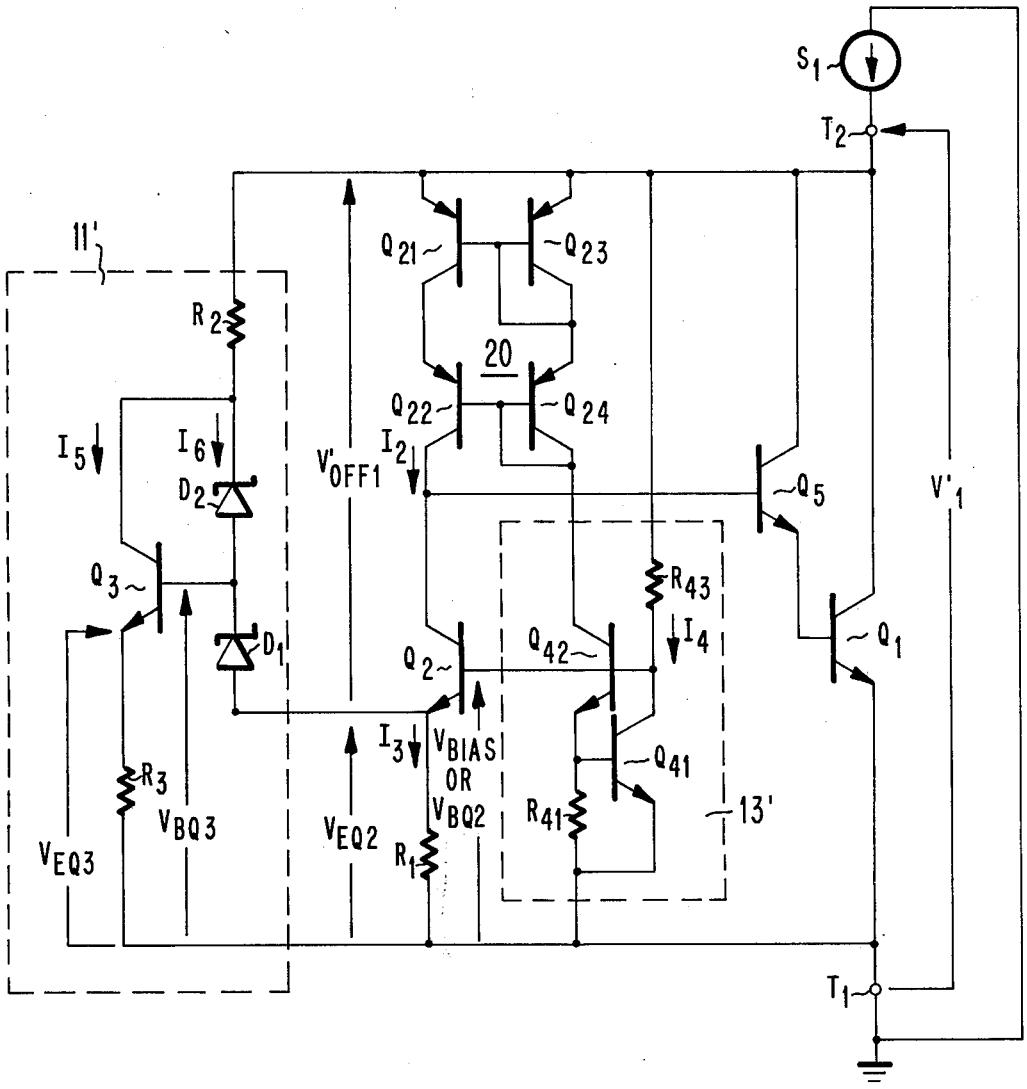
Figure 3:
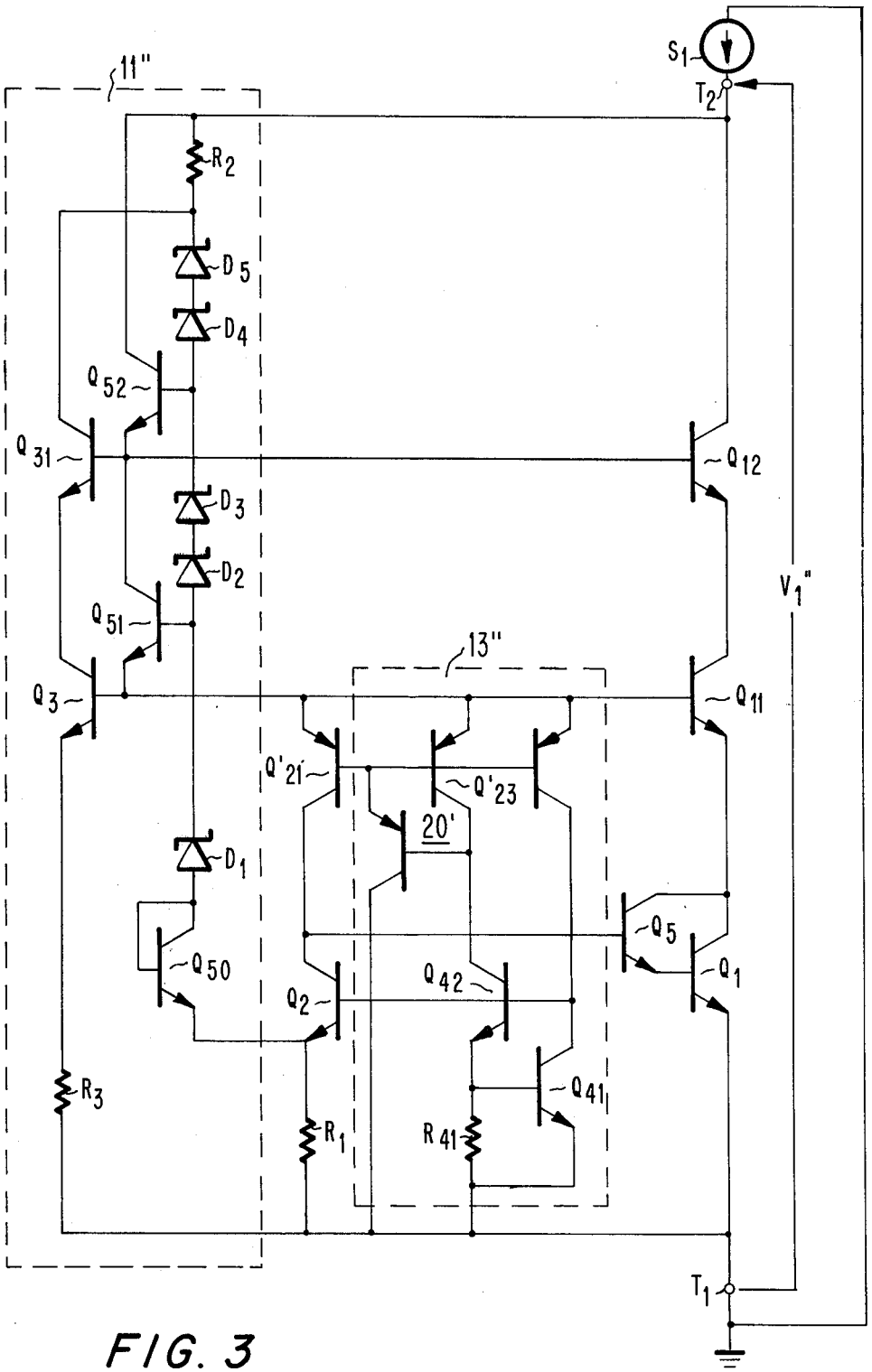
Figure 4:
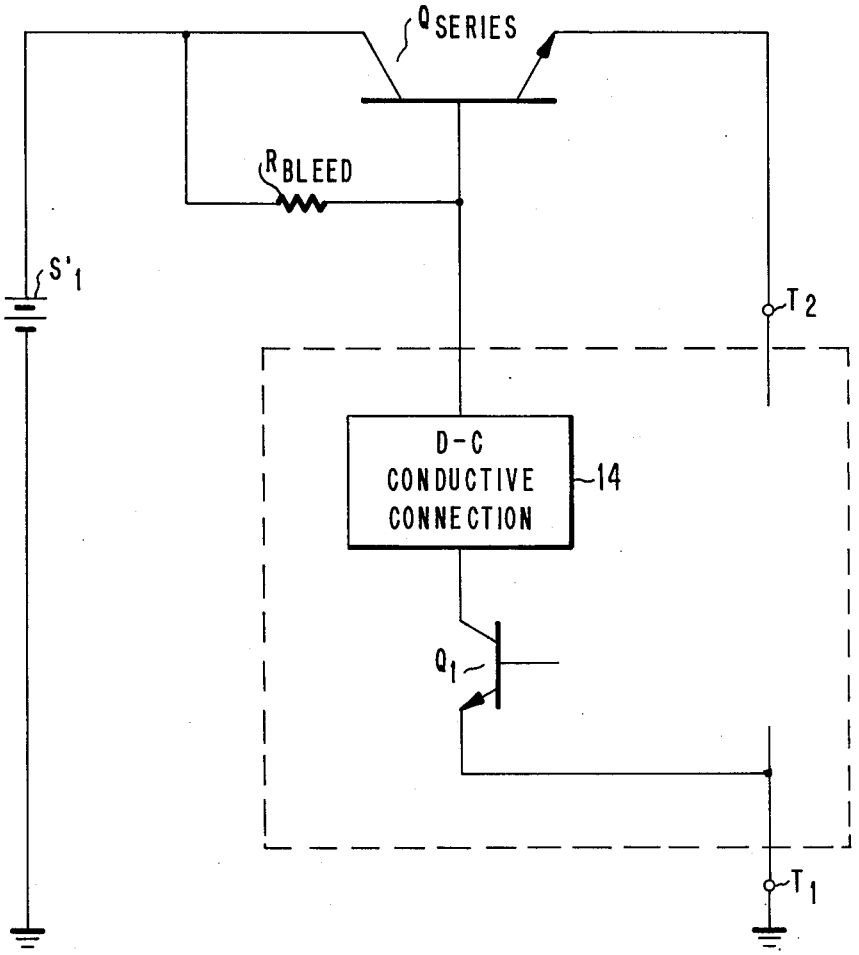

In the drawing:

each of FIGS. 1, 2 and 3 is a schematic diagram of a shunt regulator embodying the present invention; and FIG. 4 is a schematic diagram partially in block form showing how a shunt regulator of the type shown in any one of FIGS. 1, 2 and 3 can be modified for incorporation into a series regulator.

The FIG. 1 shunt voltage regulator regulates the potential $V_1$ appearing between terminals $T_1$ and $T_2$ responsive to the application of current from an operating current source $S_1$, connected between $T_1$ and $T_2$. $T_1$ is referred to a ground potential in FIG. 1. Transistor $Q_1$ has its emitter and collector connected by respective direct current conductive means (shown here as direct connections without substantial intervening impedance) to $T_1$ and to $T_2$, respectively. $Q_1$ is the principal shunt regulator transistor of the FIG. 1 voltage regulator and to implement this function is provided with a direct-coupled degenerative collector-to-base feedback connection. This feedback connection includes the connection of the collector of $Q_1$ to $T_2$, a potential offsetting means 11 providing an offset potential $V_{OFF1}$ between $T_2$ and the emitter of a common-base-amplifier transistor $Q_2$, common base amplifier transistor $Q_2$, and a potential offsetting means 12 providing an offset potential $V_{OFF2}$ between the collector of $Q_2$ and the base of transistor $Q_1$.

$Q_2$ has a direct-current conductive collector load conducting a current $I_2$. This load is shown in FIG. 1 as a current source $S_2$. $S_2$ may simply consist of a resistance connecting the collector of $Q_2$ to $T_2$ or may be a constant current generator supplying current $I_2$. A direct current conductive path is provided between the emitter of $Q_2$ and $T_1$ to conduct a current $I_3$ that is the sum of the emitter current of $Q_2$ and the current that flows through potential offsetting means 11 to enable it to provide an offset potential; this direct current path is shown in FIG. 1 as being through a current source $S_3$. Assuming $S_2$ and $S_3$ to be constant current generators, $S_3$ supplies a larger current than $S_2$ by the amount required to provide the desired current flow through potential offsetting means 11.

There is a means 13 for applying a bias potential $V_{BIAS}$ between $T_1$ and the base of $Q_2$, which bias potential is larger than the emitter-to-base offset potential $V_{BEQ2}$ of $Q_2$. This is so that the emitter potential $V_{EQ2}$ or $Q_2$ is positive with respect to ground to facilitate the function of current source $S_3$. $V_{OFF2}$ provided by potential offsetting means 12 is at least nearly as large as $V_{BIAS}$ to prevent the collector potential $V_{CQ2}$ of $Q_2$ from being so insufficiently positive as to interfere with normal operation of $Q_2$ as a transistor. $V_{CQ2}$ is maintained equal to the base potential $V_{BQ1}$ of $Q_1$ plus $V_{OFF2}$ by the direct-coupled collector-to-base feedback of $Q_1$.

The FIG. 1 regulator regulates $V_1$ to the value set forth in equation 1, following.

$$V_1 = V_{BIAS} + V_{OFF1} - V_{BEQ2} \quad (1)$$

If $V_1$ should tend to increase beyond the equation 1 value, $V_1$ as diminished by $V_{OFF1}$ is applied as $V_{EQ2}$ to $Q_2$, to which transistor $Q_2$ a base potential $V_{BQ2}$ equal to $V_{BIAS}$ is also applied. The tendency towards increase in $V_1$ thus tends to decrease $V_{BEQ2}$. Responsive to the tendency towards decreased $V_{BEQ2}$, transistor $Q_2$ tends to be less conductive, so more of the current flowing through the direct current conductive path afforded by $S_2$ tends to be available for raising the potential at the input of potential offsetting means 12 and consequently for raising $V_{BQ1}$. This tendency towards increased $V_{BQ1}$ tends to increase the conduction through $Q_1$ sufficiently to decrease $V_1$ to its equation 1 value. On the other hand, if $V_1$ should tend to decrease below the equation 1 value, $V_{BEQ2}$ tends to be increased. The resultant tendency towards increased conduction through $Q_2$ tends to decrease that portion of the current available from the direct current conductive path through $S_2$ which is available to maintain $V_{BEQ1}$. The tendency towards reduced $V_{BQ1}$ tends to decrease conduction through $Q_1$ sufficiently to permit $V_1$ to tend to increase in value.

The general type of voltage regulator described in this application is particularly attractive when one wishes to build a regulator in monolithic form, so the regulator elements can be operated at substantially the same temperature, with a view towards maintaining the regulated voltage (e.g., $V_1$) constant despite changes in the temperature of the elements in the regulator. $V_1$ in the FIG. 1 regulator can be made to have substantially zero-temperature coefficient if the $V_{BIAS}$ and $V_{OFF1}$ voltages have proper temperature coefficients, that cooperate with that of $V_{BEQ2}$ to compensate against temperature dependency in $V_1$. At least one of the $V_{BIAS}$ and $V_{OFF1}$ voltages must have a negative temperature coefficient to offset the tendency of $V_1$ to have a positive temperature coefficient. This tendency is due to the subtractive $V_{BEQ2}$ term in equation 1 exhibiting a negative temperature coefficient providing the current through $Q_2$ does not change drastically with temperature.

In a monolithically integrated circuit, a reasonably predictable positive-temperature-coefficient potential can, as is well-known, be developed across reverse-biased semiconductor junctions operated in avalanche. A predictable negative-temperature-coefficient offset potential is developed across a forward-biased semiconductor junction based at fixed current level, as is well known; and techniques for producing negative-temperature-coefficient potentials that are equal to such offset potentials multiplied by modest scaling factors are also well known. In regulators having the general configuration shown in FIG. 1, it is usually preferable that a negative-temperature-coefficient potential so produced be used as $V_{BIAS}$ rather than $V_{OFF1}$. This facilitates operation with small $V_{BQ2}$, inasmuch as the negative-temperature-coefficient offset potentials of forward-biased semiconductor junctions are several times smaller than the positive-temperature-coefficient breakdown potentials of reverse-biased semiconductor junctions. Small $V_{BQ2}$ reduces the required $V_{OFF2}$ to prevent saturation of $Q_2$, which tends to simpler structure for potential offsetting means 12.

In FIG. 1, potential offsetting means 11 is shown as consisting of serially connected reverse-biased semiconductor junctions $D_1$ and $D_2$ operated in avalanche to provide a positive temperature coefficient $V_{OFF1}$. The means 13 for supplying bias potential $V_{BIAS}$ is shown in FIG. 1 as comprising a so-called multiple $V_{BE}$ supply of the sort described by A. L. R. Limberg in U.S. Pat. No. 3,555,309 entitled "Electrical Circuits" and issued Jan. 12, 1971. The supply applies a $V_{BIAS}$ to the base of $Q_2$ that is $(R_{41} + R_{42})/R_{41}$ times as large as the emitter-to-base potential $V_{BEQ41}$ of grounded-emitter transistor $Q_{41}$. $Q_{41}$ is provided with direct-coupled degenerative collector-to-base feedback via emitter-follower transistor $Q_{42}$ and the resistive potential divider comprising resistors $R_{41}$ and $R_{42}$. This degenerative feedback adjusts its emitter-to-base potential to such value that its collector current equals the current $I_4$ supplied by current source $S_4$, less the usually negligible base current of emitter-follower transistor $Q_{41}$.

The means 12 for providing $V_{OFF2}$ translation potential between the collector of $Q_2$ and the base of $Q_1$ is shown in FIG. 1 as comprising an emitter-follower transistor $Q_5$ and a resistance $R_5$ across which a potential drop proportionally related to $V_{BEQ41}$ is maintained responsive to the collector current of transistor $Q_6$. The base-emitter junction of $Q_6$ is parallelled with that of $Q_{41}$ to maintain this proportionality. So long as $R_{42}$ is not larger in resistance than $R_{41}$, $R_5$ may be replaced by a direct connection, and the collector-base junction of $Q_2$ will be reverse-biased. For larger values of $R_{42}$, making $R_5$ at least as large as $(R_{42}-R_{41})$ times the ratio of the area of the base-emitter junction of $Q_6$ to that of $Q_{41}$ will maintain the collector-base junction of $Q_2$ in the desired reverse-biased condition that permits it to operate as a common-base amplifier.

Design in accordance with the present invention is simplified if current sources $S_2$ and $S_4$ supply equal currents, $I_2$ and $I_4$, respectively. The degenerative collector-to-base feedback of $Q_1$ maintains the collector current of $Q_2$ substantially equal to $I_2$; and, as noted above, degenerative collector-to-base feedback of $Q_{41}$ maintains its collector current substantially equal to $I_4$. So $V_{BEQ2}$ equals $V_{BEQ41}$. $V_{EQ2}$ equals $V_{BIAS}$ less $V_{BEQ2}$. Then since $V_{BIAS} = [(R_{41} + R_{42})/R_{41}]\ V_{BEQ41}$ and $V_{BEQ2} = V_{BEQ41}$, $V_{EQ2} = R_{42}/R_{41})\ V_{BEQ41}$ when $I_2 = I_4$. Current source $S_3$ is desired to supply a current $I_3$ sufficiently large not only to sink the emitter current $I_{EQ2}$ of $Q_2$, which is substantially equal to its collector current and thus to $I_2$ but also to draw current through potential offsetting means 11—that is, through the serially connected diodes $D_1$ and $D_2$ arranged for avalanche conduction. Typically, a square mil P+N+ junction on a monolithic integrated circuit breaks down at 5.4 volts at 300 Kelvin and has a 1.0 millivolt per Kelvin positive temperature coefficient, if its reverse current is constrained to a range around 0.1 milliampere. The offset potential of a square mil base-emitter junction when forward biased and conducting a forward current of 0.1 milliampere typically is 0.7 volts at 300 Kelvin and has a 1.8 millivolt per Kelvin negative temperature coefficient. Assuming $S_2$ and $S_4$ to be designed to cause the base-emitter junctions of $Q_2$ and $Q_{41}$ to conduct 0.1 milliampere, $V_{EQ2}$ would have a value $(R_{42}/R_{41})$ times 0.7 volts at 300 Kelvin, and a negative temperature coefficient of $(R_{42}/R_{41})$ times 1.8 millivolts per Kelvin. Assuming $S_3$ to be designed to demand the 0.1 milliampere $I_{EQ2}$ plus the 0.1 milliampere current through the avalanche diodes $D_1$ and $D_2$, these diodes would exhibit a combined potential offset $V_{OFF1}$ thereacross having a value of 10.8 volts at 300 Kelvin and a positive temperature coefficient of 2.0 millivolts per degree Kelvin. Where $R_{42}/R_{41}$ made to have a value of 10/9 the potentials $V_{OFF1}$ and $V_{EQ2}$ would have a combined value $V_1$ having a zero temperature coefficient and having a value of 11.6 volts.

A regulated potential $V_1$ half as large as $V_1$ could be maintained between $T_1$ and $T_2$ were potential offsetting means 11 modified to replace one of the diodes $D_1$ and $D_2$ by direct connection, and certain other multiples $nV'_1$ of $V_1$ could be obtained using *n* serially connected reverse-biased diodes in modifications of potential offsetting means 11. Also, some small adjustment of the regulated potential around these values is possible by modifying the values of $I_2$, $I_4$ and $I_3$. Nonetheless, the FIG. 1 configuration does not provide as great freedom as desired in the choice of value to which voltage is to be regulated.

The FIG. 2 regulator gives increased freedom in this regard, achieved by including a resistance $R_2$ in the potential offsetting means 11' for maintaining an offset potential $V_{OFF1}$, between terminal $T_2$ and the emitter of $Q_2$ together with means for causing a positive-temperature coefficient-related component $I_5$ of current flow through $R_2$. This means comprises transistor $Q_3$, its emitter resistance $R_3$ and the means for biasing the base of $Q_3$, ($R_1$, $R_2$ and $R_3$ will be assumed to exhibit similar temperature coefficients and to be at similar temperature in the following description, though one skilled in the art of electronic circuit design can make allowance for the transistors). The positive-temperature-coefficient-related component $I_5$ of current through $R_2$ and a negative-temperature-coefficient-related $I_6$ equal to the difference between $I_3$ and $I_2$ can be caused to flow in such proportions as to cause the potential drop across $R_2$ to take on a variety of values with a temperature coefficeint anywhere between the positive- and negative-temperature-coefficients to which $I_5$ and $I_6$ are related by $R_3$ and $R_1$, respectively. This affords great flexibility of choice in the value of $V_{OFF1'}$, rather than limiting it to multiples of the reverse breakdown voltage $V_Z$ of $D_1$.

The means 13' for applying bias potential $V_{BIAS}$ to the base of $Q_2$ shown in FIG. 2 is a multiple-$V_{BE}$ supply of the type described by L. A. Harwood in U.S. Pat. No. 3,430,155 issued Feb. 25, 1969, and entitled "Integrated Circuit Biasing Arrangement for Supplying $V_{be}$ Bias Voltages" and applies a $V_{BIAS}$ equal to the sum of the emitter-to-base potentials $V_{BEQ41}$ and $V_{BEQ42}$ of $Q_{41}$ and $Q_{42}$, respectively. The constant current $I_2$, which the collector current of $Q_2$ is adjusted to equal by the direct-coupled degenerative collector-to-base feedback of $Q_1$, is supplied by the output circuit of a current mirror amplifier 20. Current mirror amplifier 20 is of the type described by H. A. Wittlinger in U.S. Pat. No. 3,835,410 issued Sept. 10, 1974, and entitled "Current Amplifier". The output circuit of current mirror amplifier 20 includes transistors $Q_{21}$ and $Q_{22}$ in cascode connection and exhibits the high output impedance that assures that variations in the emitter current of $Q_2$ will be applied in full to the base of $Q_5$. The current provided by this cascode arrangement is related to the current flowing through the serially connected self-biased transistors $Q_{23}$ and $Q_{24}$ in the same ratio as the collector current versus emitter-to-base voltage characteristics of $Q_{21}$ is related to that of $Q_{23}$, owing to the emitter-to-base circuits of $Q_{21}$ and $Q_{23}$ being in parallel. The respective emitter-to-base offset potentials $V_{BEQ23}$ and $V_{BEQ24}$ of $Q_{23}$ and $Q_{24}$ combine to provide a bias voltage for the base of $Q_{22}$. The current $I_4$ flowing through resistance $R_{43}$ connecting $T_2$ to the collector of transistor 41 is in accordance with Ohm's Law equal to $V_1 - V_{BEQ41} - V_{BEQ42}$. The direct-coupled degenerative collector-to-base feedback connection of $Q_{41}$ via emitter-follower transistor $Q_{42}$ maintains $V_{VEQ41}$ across resistance $R_{41}$ at a value to support a collector current demanded by $Q_{41}$ substantially equal to $I_4$. The current flow through $R_{43}$ necessary to do this has a value $C_{BEQ41}/R_{41}$ and is the principal component of the emitter current of $Q_{42}$. The collector current of $Q_{42}$, assuming $Q_{42}$ to have the usual common emitter forward current gain (i.e., $h_{fe}$) or 30 or so, is substantially equal to its emitter current and then to $V_{BEQ41}/R_{41}$. By making the current gain of current minor amplifier 20 equal to minus unity, so $I_2$ substantially equals ($V_{BEQ41}/R_{41}$), one causes $V_{BEQ2}$ to equal $V_{BEQ42}$ and thus $V_{EQ2}$ to equal $V_{BEQ41}$. With the emitter potential $V_{EQ2}$ of $Q_2$ substantially equal to $V_{BEQ41}$, the base potential $V_{BQ3}$ of transistor $Q_3$ will substantially equal $V_{BEQ41}$ plus the breakdown voltage $V_Z$ across avalanche diode $D_1$, assuming $I_3$ to exceed $I_2$ sufficiently to operate $D_1$ in avalanche. The emitter potential $V_{EQ3}$ of $Q_3$ will be lower than $V_{BQ3}$ by the emitter-to-base offset potential $V_{BEQ3}$ of $Q_3$ and will be substantially equal to $V_2$ as applied across resistance $R_3$ will according to Ohm's Law cause an emitter current substantially equal to $V_Z/R_2$ to be demanded of $Q_3$.

Assuming $Q_3$ to have the usual $h_{fe}$ of at least 30 or so, $Q_3$ demands a collector current substantially equal to the emitter current demanded of it. This collector current demand, as supplied from source $S_1$ via resistance $R_2$ included in potential offsetting means 11' and connected between terminal $T_2$ and the collector of $Q_3$ causes a positive-temperature-coefficient potential component of drop equal to $(R_2/R_3)V_Z$ across resistance $R_2$. So the sum of the positive-temperature-coefficient components of potential offset between terminal $T_2$ and the emitter of $Q_2$ is the $(R_2/R_3)V_Z$ component of potential drop across $R_2$ plus the two $V_Z$ drops across diodes $D_2$ and $D_1$. By changing the ratio of $R_2$ to $R_3$, this $[2 + (R_2/R_3)]V_Z$ potential can be adjusted over a continuous range of values.

There is a further, negative-temperature-coefficient component of potential drop across $R_2$ caused by the flow of a current equal to $(I_3\text{-}I_2)$ through $R_2$, avalanche diodes $D_2$ and $D_1$, and a resistance $R_1$ connected between the emitter of $Q_2$ and $T_1$. $R_1$ determines the value of $I_3$ in accordance with Ohm's Law, $I_3$ being $V_{EQ2}/R_1$. Since $V_{EQ2}$ is substantially equal to $V_{BEQ41}$, $I_3$ is substantially equal to $V_{BEQ41}/R_1$. Since $I_3$ is substantially equal to $V_{BEQ41}/R_1$ and $I_2$ is substantially equal to $V_{BEQ41}/R_{41}$, $(I_3 - I_2)$ is substantially equal to $V_{BEQ41}$ $[(R_{41} - R_1)/R_1R_{41}]$. This $(I_3 - I_2)$ current flow through $R_2$ will cause a negative-temperature-coefficient component of voltage drop thereacross which by Ohm's Law is substantially $V_{BEQ41}$ $[R_2(R_{41}-R_1)/R_1R_{41}]$. The total potential drop across $R_2$ is then $(R_2/R_3)V_Z + [R_2(R_{41}-R_1)/R_1 R_{41}]$ $V_{BEQ41}$. $V_{OFF1}$ is $[2+(R_2/R_3)]V_Z + [R_2(R_{41}-R_1)/R_1R_{41}]$ $V_{BEQ41}$. Since $V_{EQ2} = V_{BIAS} - V_{BEQ2}$ is $V_{BEQ41}$ according to equation 1, $V_1'$ has the following value for the FIG. 2 circuit.

$$V_1' = [2+(R_2/R_3)]V_Z + \{1+[R_2(R_{41}-R_{42})/R_1R_{41}]\}\ V_{BEQ41} \quad (2)$$

Appropriate scaling of $R_1$ and $R_2$ to $R_3$ will provide zero-temperature-coefficient $V_1'$ of any value ranging upward from the value somewhat larger than $2V_Z$ associated with the degenerate form of the FIG. 2 circuit in which $R_3$ would have infinite resistance and thus could be discarded together with $Q_3$.

FIG. 3 shows a shunt-voltage regulator suitable for developing a regulated potential $V_{1''}$ which is of higher value than the emitter-to-collector potential a single transistor will withstand. $Q_1$ has further transistors $Q_{11}$ and $Q_{12}$ connected in cascode therewith and $Q_3$ has further transistor 31 connected in cascode therewith. The base bias potentials for these further transistors are taken from points in the means 11'' for providing an offset potential $V_{OFF1}''$. $Q_3$ and $Q_{11}$ have base potentials substantially equal to $V_Z + V_{BEQ41}$ applied to them by the emitter follower action of transistor $Q_{51}$, self-biased transistor $Q_{50}$ being used to compensate for the emitter-to-base offset potential $V_{BEQ51}$ of $Q_{51}$. (This additional $V_{BEQ51}$ term is a component of $V_{OFF1}''$). $Q_{31}$ and $Q_{12}$ have base potentials substantially equal to $3V_Z + V_{BEQ41}$ applied to them by the emitter-follower action of transistor $Q_{52}$.

$V_1''$ will be regulated to the following value.

$$V_1''=[5+(R_2/R_3)]V_Z+V_{BEQ51}+\{1+[R_2(R_{41}-R_{42})/R_1R_{42}]\}\ V_{BEQ41} \quad (3)$$

Higher values of regulated voltage can be developed between terminals $T_1$ and $T_2$ by including further avalanche diodes in the series connection of self-biased transistor $Q_{50}$ and of diodes $D_1$, $D_2$, $D_3$, $D_4$, $D_5$ and extending the cascoding used in connection with transistors $Q_3$ and $Q_1$.

The FIG. 3 regulator also differs somewhat from that of FIG. 2 in that current mirror amplifier 20 is replaced by a known type of dual-output current mirror amplifier 20'. The input circuit of current mirror amplifier 20' is receptive of the collector current of transistor $Q_{42}$ to provide constant current $I_2$ from one of its output circuits and further to complete a positive feedback connection to the collector of $Q_{41}$ that supplies $I_4$ in lieu of $R_{43}$ of FIG. 2.

A convenient way to obtain values for the ratios between $R_1$, $R_2$ and $R_3$ in the regulator of FIGS. 1, 2 or 3 is to use a method for design of temperature independent networks of the sort taught by A. L. R. Limberg in U.S. Pat. No. 3,534,245 issued Oct. 13, 1970, and entitled "Electrical Circuit for Providing Substantially Constant Current". First, partially differentiate the equation 1, 2 or 3 describing its regulated output voltage, using temperature as the variable of differentiation; and, second, cross-solve the equation resulting from partial differentiation against the original equation. This design technique was used to design a 33 volt regulator having the FIG. 3 configuration. The diodes $D_1$-$D_5$ were of P+N+ types previously described; and $R_1$, $R_2$ and $R_3$ had respective values of 4300, 10,000, and 14,000 ohms.

The dynamic source impedance exhibited between $T_1$ and $T_2$ of the regulators in FIGS. 2 and 3 can be estimated as follows. The input resistance to common base amplifier transistor $Q_2$ is substantially comprised by $R_2$, reverse-biased semiconductor junctions $D_1$-$D_5$ and the forward-biased base-emitter junction exhibiting relatively low resistances. A change $\Delta V$ in the potential between $T_1$ and $T_2$ would appear primarily across $R_2$ causing a change $\Delta I$ in current therein substantially equal to $\Delta V/R_2$. This change in current is coupled through common base amplifier transistor $Q_2$ to cause a like change in the base current applied to $Q_5$. This $\Delta I$ change in the base current of $Q_5$ is amplified by a factor substantially equal to the product of the common-emitter forward current gains $h_{fe5}$ and $h_{fe1}$ of transistors $Q_5$ and $Q_1$ to cause a change in the collector current of shunt regulator transistor $Q_1$ that opposes the change $\Delta V$. A change in $I_1$ larger than $\Delta I$ by a factor substantially equal to $h_{fe5}\,h_{fe1}$ is necessary to cause that $\Delta V$ that $\Delta I$ would cause in $R_2$, so the dynamic source impedance exhibited between $T_1$ and $T_2$ may be inferred to be of the order of $R_2/h_{fe5}\,h_{fe1}$. This dynamic slope impedance for an $R_2$ of 10,000 ohms and $h_{fe5}$ and $h_{fe6}$ of 100 or so is of the order of only one ohm. The output impedance can be reduced still further, if desired, by including further transistors in direct coupled cascade connection before $Q_1$.

Armed with the foregoing disclosure one skilled in the art of circuit design will be able to design numerous alternatives to the specific regulators described and this should be considered in construing the scope of the claims. For example, self-biased transistor $Q_{50}$ in FIG. 3 might be replaced by a resistance properly proportioned to $R_1$. Or self-biased transistor $Q_{50}$ could be replaced in FIG. 3 by direct connection, at the same time inserting a resistance $R_{42}$ equal to $R_{41}$ between the emitter of $Q_{42}$ and base of $Q_{41}$ and suitably modifying the direct coupling between the emitter of $Q_5$ and base of $Q_1$. Also, means other than $Q_3$, $R_3$ may be used to develop the current that causes a positive-temperature-coefficient component of drop across $R_3$; such a current may be provided in FIG. 2 for instance from the collector of a transistor having its emitter-to-base circuit parallelled with that of $Q_{41}$, with self-biased transistors connected for easy conduction and in series with $R_{43}$ to obtain the positive-temperature-coefficient if necessary or to improve it if desired.

FIG. 4 shows how the shunt regulator described in connection with FIGS. 1, 2 or 3 can be modified for inclusion in a series regulator. $Q_1$ is connected by direct-current conductive connection 14, not to terminal $T_2$, but rather to the base electrode of a series pass transistor $Q_{SERIES}$. $Q_{SERIES}$ has its collector current connected to a source $S_1'$ of operating potential and its emitter connected to the terminal $T_2$. A bleeder resistor $R_{BLEED}$ bleeds current between connections at the collector and base electrodes of $Q_{SERIES}$ to supply the base current $Q_{SERIES}$ required to regulate the potential between $T_1$ and $T_2$ to desired value and to supply an excess of current over this need which flows to the collector of shunt regulator transistor $Q_1$.

What is claimed is:

1. A voltage regulator for regulating the voltage applied between its first and second terminals from a source of operating current, said voltage regulator comprising in addition to said first and second terminals the following:

first and second transistors of a first conductivity type, each having base and emitter and collector electrodes;

means connecting said first transistor as a shunt regulator for controlling the potential appearing between said first and said second terminals, which means includes first direct current conductive means that is between the emitter electrode of said first transistor and said first terminal, and includes means directly responsive to the collector current of said first transistor for reducing the potential at said second terminal; as referred to the potential at said first terminal; and a direct-coupled degenerative collector-to-base feedback connection of said first transistor wherein said second transistor is included in common-base amplifier configuration, said feedback connection including for connecting said second transistor in said common-base amplifier configuration:

potential offsetting means for applying a first offset potential between said second terminal and the emitter electrode of said second transistor, second direct current conductive means that is between the emitter electrode of said second transistor and said first terminal, means for applying a bias potential between said first terminal and the base electrode of said second transistor;

means direct coupling the collector electrode of said second transistor to the base electrode of said first transistor, and third direct current conductive means that is between said second terminal and the collector electrode of said second transistor.

2. A voltage regulator as set forth in claim 1 which is a shunt voltage regulator wherein said means directly responsive to the collector current of said first transistor for reducing the potential at said second terminal as referred to the potential at said first terminal comprises:

a fourth direct current conductive means that is between the collector electrode of said first transistor of said second terminal.

3. A voltage regulator as set forth in claim 2 wherein said fourth direct current conductive means comprises a further transistor connected in common-base amplifier configuration for the collector current of said first transistor, said further transistor having an emitter electrode to which the collector electrode of said first transistor direct current conductively connects and having a collector electrode direct current conductively connected to said second terminal, thereby to form a cascode configuration with said first transistor.

4. A voltage regulator as set forth in claim 2 wherein said second transistor has a base-emitter junction between its base and emitter electrodes which is operated at a temperature T and exhibits a second offset potential thereacross that exhibits a negative-temperature-coefficient in T, wherein said potential offsetting means includes direct-current conductive path through at least one reverse-biased semiconductor junction operated at said temperature T and responds to said temperature T to cause said first offset potential to exhibit a positive temperature coefficient in T, wherein said means for applying a bias potential between said first terminal and the base electrode of said second transistor responds to said temperature T to apply a bias potential that exhibits a temperature coefficient related to the coefficients of said first and said second offset potentials such that the regulated potential between said first and said second terminals exhibits a substantially zero temperature coefficient.

5. A voltage regulator as set forth in claim 2 wherein said second transistor has a base-emitter junction between its base and emitter electrodes which is operated at a temperature T and exhibits a second offset potential thereacross that exhibits a negative temperature coefficient in T, wherein said means for applying a bias potential between said first terminal and the base electrode of said second transistor applies a potential that is proportional to the offset potential across a forward-biased semiconductor junction operated at said temperature T and that therefore exhibits a negative-temperature-coefficient in T, wherein said second direct current conductive means consists of a first resistance connecting the emitter electrode of said second transistor and said first terminal, and wherein said potential offsetting means includes the serial connection of at least one reverse-biased semiconductor junction operated at said temperature T and a second resistance between said second terminal and the emitter electrode of said second transistor, said second resistance being of a value respective to that of said first resistance such that the regulated potential between said first and said second terminals exhibits a substantially zero temperature coefficient.

6. A voltage regulator as set forth in claim 5 further including means connected across said second resistance for causing a current flow therethrough giving rise to a positive-temperature-coefficient component of potential drop thereacross.

7. A voltage regulator as set forth in claim 5 wherein the direct current conductive path in said potential offsetting means is through a plurality of serially connected reverse-biased semiconductor junctions with an interconnection between each adjoining pair thereof and wherein said fourth direct current conductive means comprises at least one further transistor in cascode connection with said first transistor; each said further transistor having a base electrode connected to receive bias potential from a separate one of said interconnections between each adjoining pair of serially connected reverse-biased semiconductor junctions, having an emitter electrode to which the collector electrode of said first transistor is direct current conductively connected, and having a collector electrode direct current conductively connected to said second terminal.

8. A voltage regulator as set forth in claim 2 wherein said second transistor has a base-emitter junction between its base and emitter electrodes which is operated at a temperature T and exhibits a second offset potential thereacross that exhibits a negative temperature coefficient in T, wherein said means for applying a bias potential between said first terminal and the base electrode of said second transistor applies a potential that is proportional to the offset potential across a forward-biased semiconductor junction operated at said temperature T and that therefore exhibits a negative temperature coefficient in T, wherein said second direct current conductive means consists of a first resistance connecting the emitter electrode of said second transistor and said first terminal, and wherein said potential offsetting means includes a third transistor of said first conductivity type and with base and emitter and collector electrodes, a second resistance having a first end connected to said second terminal and having a second end, fifth direct current conductive means connecting the collector electrode of said third transistor to the second end of said second resistance, a third resistance connected between said first terminal and the emitter electrode of said third transistor, a plurality of reverse-biased semiconductor junctions in serial connection between the second end of said second resistance and the emitter electrode of said second transistor with an interconnection between each adjoining pair of reverse-biased semiconductor junctions in said serial connection thereof, and means applying the potential appearing at one of said interconnections to the base electrode of said third transistor, said third transistor being operated at a temperature substantially equal to T, and said second and said third resistances having values respective to that of said first resistance such that the regulated potential between said first and said second terminal exhibits a substantially zero temperature coefficient.

9. A voltage regulator as set forth in claim 8 wherein said fifth direct current conductive means includes an integral number $n$ at least one of further transistors in cascode connection with said third transistor; each of said further transistors having a base electrode connected to a separate one of said interconnections between each adjoining pair of serially connected reverse biased junctions, having an emitter electrode to which the collector electrode of said third transistor is direct current conductively connected, and having a collector electrode direct current conductively connected to the second end of said second resistance.

10. A voltage regulator as set forth in claim 9 wherein said forth direct current conductive means includes an integral number $(n + 1)$ of still further transistors in cascode connection with said first transistor; each of said still further transistors having a base electrode connected to a separate one of said interconnections between each adjoining pair of serially-connected reverse-biased semiconductor junctions, having an emitter electrode to which the collector electrode of said first transistor is direct current conductively connected and having a collector electrode direct current conductively connected to said second terminal.

11. A voltage regulator as set forth in claim 1 which is a series voltage regulator including a series pass transistor, for completing the connection of said source of operating current between said first and second terminals, said series pass transistor having base and emitter and collector electrodes, with the emitter electrode of said series pass transistor being connected to said second terminal; said series regulator also including means for bleeding current connected between the collector and base electrodes of said series pass transistor, wherein said means directly responsive to the collector current of said first transistor for reducing the potential at said second terminal as referred to the potential at said first terminal comprises said bleeder resistor, the base emitter junction of said series pass resistor, and fourth direct current conductive means between the collector electrode of said first transistor and the base electrode of said series pass transistor.

12. A voltage regulator as set forth in claim 11 wherein said fourth direct current conductive means comprises a further transistor connected in common base amplifier configuration for the collector current of said first transistor, said further transistor having an emitter electrode to which the collector electrode of said first transistor direct current conductively connects and having a collector electrode direct current conductively connected to said second terminal, thereby to form a cascode configuration with said first transistor.

13. A voltage regulator as set forth in claim 11 wherein said second transistor has a base-emitter junction between its base and emitter electrodes which is operated at a temperature T and exhibits a second offset potential thereacross that exhibits a negative temperature coefficient in T, wherein said potential offsetting means includes direct-current conductive path through at least one reverse-biased semiconductor junction operated at said temperature T and responds to said temperature T to cause said first offset potential to exhibit a positive temperature coefficient in T, wherein said means for applying a bias potential between said first terminal and the base electrode of said second transistor responds to said temperature T to apply a bias potential that exhibits a temperature coefficient that is related to the coefficients of said first and said second offset potentials such that the regulated potential between said first and said second terminals exhibits a substantially zero temperature coefficient.

14. A voltage regulator as set forth in claim 11 wherein said second transistor has a base-emitter junction between its base and emitter electrodes which is operated at a temperature T and exhibits a second offset potential thereacross that exhibits a negative temperature coefficient in T, wherein said means for applying a bias potential between said first terminal and the base electrode of said second transistor applies a potential that is proportional to the offset potential across a forward-biased semiconductor junction operated at said temperature T and that therefore exhibits a negative-temperature-coefficient in T, wherein said second direct current conductive means consists of a first resistance connecting the emitter electrode of said second transistor and said first terminal, and wherein said potential offsetting means includes the serial connection of at least one reverse-biased semiconductor junction operated at said temperature T and a second resistance between said second terminal and the emitter electrode of said second transistor, said second resistance being of a value respective to that of said first resistance such that the regulated potential between said first and said second terminals exhibits a substantially zero temperature coefficient.

15. A voltage regulator as set forth in claim 14 further including means connected across said second resistance for causing a current to flow therethrough giving rise to a positive-temperature-coefficient component of potential drop thereacross.

16. A voltage regulator as set forth in claim 14 wherein the direct current conductive path in said potential offsetting means is through a plurality of serially connected reverse-biased semiconductor junctions with an interconnection between each adjoining pair thereof and wherein said fourth direct current conductive means comprises at least one further transistor in cascode connection with said first transistor; each said further transistor having a base electrode connected to receive bias potential from a separate one of said interconnections between each adjoining pair of serially connected reverse-biased semiconductor junctions, having an emitter electrode to which the collector electrode of said first transistor is direct current conductively connected, and having a collector electrode direct current conductively connected to the base electrode of said series pass transistor.

17. A voltage regulator as set forth in claim 11 wherein said second transistor has a base-emitter junction between its base and emitter electrodes which is operated at a temperature T and exhibits a second offset potential thereacross that exhibits a negative temperature coefficient in T, wherein said means for applying a bias potential between said first terminal and the base electrode of said second transistor applies a potential that is proportional to the offset potential across a forward-biased semiconductor junction operated at said temperature T and that therefore exhibits a negative temperature coefficient in T, wherein said second direct current conductive means consists of a first resistance connecting the emitter electrode of said second transistor and said first terminal, and wherein said potential offsetting means includes a third transistor of said first conductivity type and with base and emitter and collector electrodes, a second resistance having a first end connected to said second terminal and having a second end, fifth direct current conductive means connecting the collector electrode of said third transistor to the second end of said second resistance, a third resistance connected between said first terminal and the emitter electrode of said third transistor, a plurality of reverse-biased semiconductor junctions in serial connection between the second end of said second resistance and the emitter electrode of said second transistor with an interconnection between each adjoining pair of reverse-biased semiconductor junctions in said serial connection thereof, and means applying the potential appearing at one of said interconnections to the base electrodes of said third transistor, said third transistor being operated at a temperature substantially equal to T, and said second and said third resistances having values respective to that of said first resistance such that the regulated potential between said first and said second terminals exhibits a substantially zero temperature coefficient.

18. A voltage regulator as set forth in claim 17 wherein said fifth direct current conductive means includes an integral number *n* at least one of further transistors in cascode connection with said third transistor; each of said further transistors having a base electrode connected to a separate one of said interconnections between each adjoining pair of serially connected reverse-biased junctions, having an emitter electrode to which the collector electrode of said third transistor is direct current conductively connected, and having a collector electrode direct current conductively connected to the second end of said second resistance.

19. A voltage regulator as set forth in claim 18 wherein said fourth direct current conductive means includes an integral number ($n + 1$) of still further transistors in cascode connection with said first transistor; each of said still further transistors having a base electrode connected to a separate one of said interconnections between each adjoining pair of serially connected reverse-biased semiconductor junctions, having an emitter electrode to which the collector electrode of said first transistor is direct current conductively connected and having a collector electrode direct current conductively connected to the base electrode of said series pass transistor.

20. A voltage regulator as set forth in claim 1 wherein said third direct current conductive means comprises a constant current generator means.

21. A voltage regulator as set forth in claim 1 wherein said means direct coupling the collector electrode of said second transistor to the base electrode of said first transistor includes at least one transistor in common-collector amplifier configuration with respect to said direct coupling.

* * * * *